US008959879B2

(12) United States Patent
Iwasaki et al.

(10) Patent No.: US 8,959,879 B2
(45) Date of Patent: Feb. 24, 2015

(54) VERTICAL BAG-MANUFACTURING AND PACKAGING MACHINE

(75) Inventors: Yoshio Iwasaki, Shiga (JP); Masayuki Yamane, Shiga (JP); Taro Sano, Shiga (JP); Akira Yamamoto, Shiga (JP)

(73) Assignee: Ishida Co., Ltd., Kyoto (JP)

( * ) Notice: Subject to any disclaimer, the term of this patent is extended or adjusted under 35 U.S.C. 154(b) by 633 days.

(21) Appl. No.: 13/094,064

(22) Filed: Apr. 26, 2011

(65) Prior Publication Data

US 2011/0265432 A1 Nov. 3, 2011

(30) Foreign Application Priority Data

Apr. 28, 2010 (JP) ..... 2010-104359

(51) Int. Cl.
*B65B 9/20* (2012.01)

(52) U.S. Cl.
USPC ..... 53/551; 53/450; 53/451; 53/550; 53/554

(58) Field of Classification Search
USPC ..... 53/451, 551, 450, 545, 548, 550, 552, 53/554–555
See application file for complete search history.

(56) References Cited

U.S. PATENT DOCUMENTS

| | | | | |
|---|---|---|---|---|
| 3,415,171 | A * | 12/1968 | Wilson | 493/302 |
| 3,731,451 | A | 5/1973 | Sexstone et al. | |
| 5,320,146 | A * | 6/1994 | Stevie | 141/1 |
| 6,085,491 | A | 7/2000 | Bois | |
| 6,904,737 | B2 * | 6/2005 | Engesser et al. | 53/451 |
| 7,028,448 | B2 * | 4/2006 | Engesser et al. | 53/451 |
| 7,240,466 | B2 * | 7/2007 | Vermee et al. | 53/417 |
| 2012/0159905 | A1 * | 6/2012 | Tsuruta et al. | 53/451 |

FOREIGN PATENT DOCUMENTS

| | | | |
|---|---|---|---|
| DE | 102007056293 | A1 | 5/2009 |
| JP | 54-014815 | U | 1/1979 |
| JP | 59-186201 | U | 12/1984 |
| JP | 60-066120 | A | 4/1985 |
| WO | 2006-005996 | A1 | 1/2006 |

OTHER PUBLICATIONS

Extended European Search Report of the corresponding European Patent Application No. 11164155.1, dated Oct. 31, 2011.

* cited by examiner

*Primary Examiner* — Christopher Harmon
(74) *Attorney, Agent, or Firm* — Global IP Counselors, LLP

(57) ABSTRACT

A vertical bag-manufacturing and packaging machine includes a feeding unit having an upstream tube portion, an opening/closing mechanism, and a downstream tube portion. The upstream tube portion is configured and arranged to downwardly convey the article. The opening/closing mechanism is disposed on a downstream side of the upstream tube portion with a gap being formed between a downstream end of the upstream tube portion and an upstream end of the opening/closing mechanism, and configured and arranged to selectively open or close to selectively discharge or hold the article discharged by the upstream tube portion. The downstream tube portion is disposed on a downstream side of the opening/closing mechanism, and configured and arranged to downwardly convey the article discharged by the opening/closing mechanism, the downstream tube portion having an internal diameter that is larger than an internal diameter of the upstream tube portion.

14 Claims, 17 Drawing Sheets

VERTICAL BAG-MANUFACTURING AND PACKAGING MACHINE

CROSS-REFERENCE TO RELATED APPLICATIONS

This application claims priority to Japanese Patent Application No. 2010-104359 filed on Apr. 28, 2010. The entire disclosure of Japanese Patent Application No. 2010-104359 is hereby incorporated herein by reference.

BACKGROUND

1. Technical Field

The present invention relates to a vertical bag-manufacturing and packaging machine which is provided with an automatic combination weighing device and a product packaging device.

2. Related Art

There has been daily research and development of packaging devices for packaging of products.

For example, Japanese Utility Model Publication No. 54-14815 discloses a tubular wall body structure in a tubular-bag-manufacturing device configured so as to form a tubular bag by using a heat sealing member to apply a heat seal on a packaging strip which is fed so as to gradually form a tube via a gap formed between a tubular wall body and a guide member that is provided facing the external periphery of the tubular wall body, wherein the tubular wall body structure is formed by providing a plurality of groove-ridge lines to the tubular wall body in the longitudinal direction thereof.

SUMMARY

As described above, in the tubular wall body structure described in Japanese Utility Model Publication No. 54-14815, groove-ridge lines having a corrugated cross-sectional shape are provided in the longitudinal direction, and effects are demonstrated whereby the surface area of heat radiation is increased, heat retention is reduced, and contact resistance with the packaging strip can be reduced. Consequently, since thermal conduction is slow, granules and other fillings do not adhere to the inner surface of the tubular wall, and flow is facilitated.

However, in recent techniques, the need for high-speed processing and reliability with respect to products is increased, and contact between the article as such and the internal peripheral surface in the tube is a problem, rather than the effects of heat or thermal conduction. In other words, in order to increase processing speed, the article as the contents must be received in a short period of time into a single bag that is to be manufactured. Specifically, in a case in which articles to be accommodated in a single bag must be dropped as a single article group, and the articles touch the internal peripheral surface in the tube, the length of the single article group during dropping increases, and increased processing speed is difficult to achieve.

An object of the present invention is to provide a vertical bag-manufacturing and packaging machine whereby an article can be transferred without coming in contact with the internal peripheral surface of the straight tube.

A vertical bag-manufacturing and packaging machine according to a first aspect includes a feeding unit configured and arranged to convey an article supplied from an upstream portion downwardly to a downstream portion. The feeding unit includes an upstream tube portion, an opening/closing mechanism, and a downstream tube portion. The upstream tube portion is configured and arranged to downwardly convey the article. The opening/closing mechanism is disposed on a downstream side of the upstream tube portion with a gap being formed between a downstream end of the upstream tube portion and an upstream end of the opening/closing mechanism, and configured and arranged to selectively open or close to selectively discharge or hold the article discharged by the upstream tube portion. The downstream tube portion is disposed on a downstream side of the opening/closing mechanism, and configured and arranged to downwardly convey the article discharged by the opening/closing mechanism, the downstream tube portion having an internal diameter that is larger than an internal diameter of the upstream tube portion.

BRIEF DESCRIPTION OF THE DRAWINGS

Referring now to the attached drawings which form a part of this original disclosure.

DETAILED DESCRIPTION OF EXEMPLARY EMBODIMENTS

Figure 1:
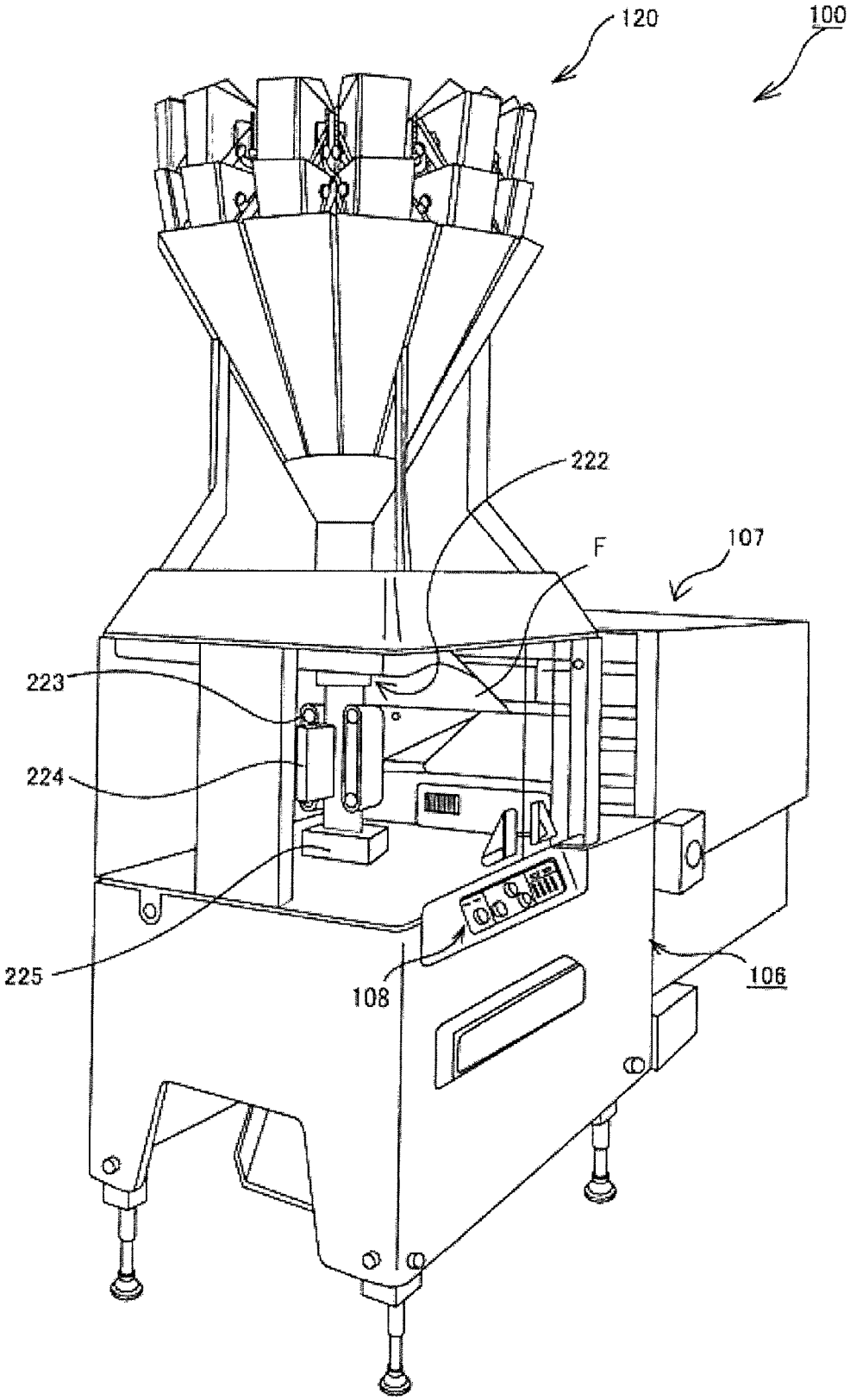
FIG. 1 is an overall perspective view showing an example of the vertical bag-manufacturing and packaging machine according to the present invention.

The vertical bag-manufacturing and packaging machine 100 according to an embodiment of the present invention will be described with reference to the drawings. FIG. 1 is a schematic external view showing an example of the vertical bag-manufacturing and packaging machine 100 according to the present invention.

As shown in FIG. 1, the vertical bag-manufacturing and packaging machine 100 is provided with a combination weighing device 120, a former 222, a pull-down belt 223, a vertical sealing device 224, a lateral sealing device 225, a bag-manufacturing and packaging unit 106, a film feeding unit 107, and operating switches 108.

The combination weighing device 120 weighs a predetermined weight of products as a separate portion in a weighing hopper, and then combines the weighed values to attain a predetermined total weight, sequentially discharges the products, and packs the predetermined total weight of products in bags through the use of an elongated film F.

The bag-manufacturing and packaging unit 106 is the main portion for packing the products in bags. The film feeding unit 107 feeds the elongated film F for the bags to the bag-manufacturing and packaging unit 106. The operating switches 108 are provided on the front surface of the bag-manufacturing and packaging unit 106.

The film feeding unit 107 is a unit for feeding the sheet-shaped elongated film F to the former 222 of the bag-manufacturing and packaging unit 106, and is provided adjacent to the bag-manufacturing and packaging unit 106. A film roll on which the elongated film F is wound is set in the film feeding unit 107, and the elongated film F is let out from the film roll.

Figure 2:
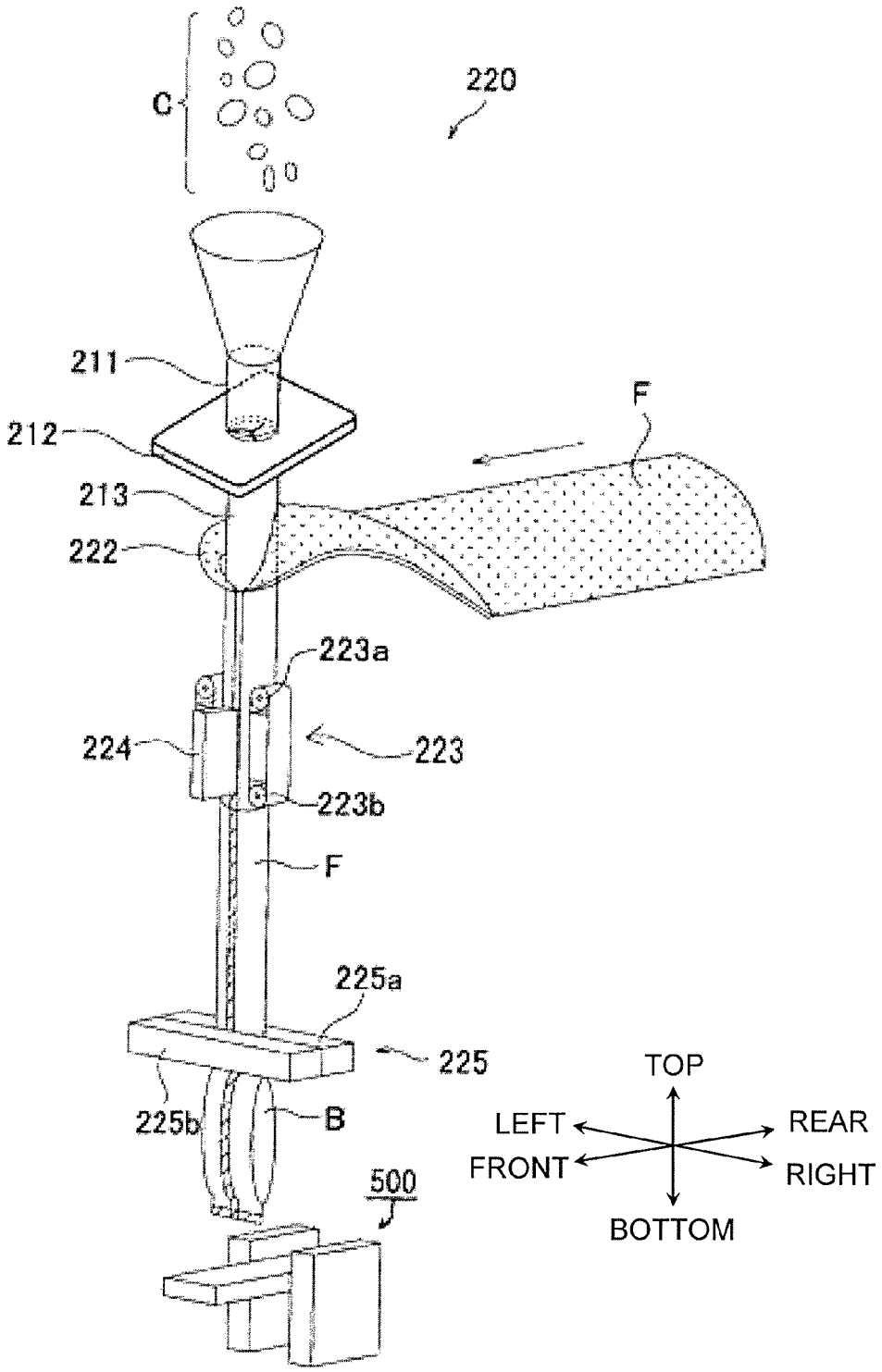
FIG. 2 is a schematic view showing the internal structure of a portion of the vertical bag-manufacturing and packaging machine.

FIG. 2 is a schematic view showing the internal structure of a portion of the vertical bag-manufacturing and packaging machine 100.

The internal structure of a portion of the vertical bag-manufacturing and packaging machine 100 as shown in FIG. 2 is primarily provided with an upstream tube 211 composed of a vertically open tube; an iris shutter 212; a downstream tube 213 composed of a vertically open tube; the former 222; the pull-down belt 223; the vertical sealing device 224; the lateral sealing device 225; and a bag compactor 500.

As shown in FIG. 2, the upstream tube 211 is disposed at a predetermined gap from the top side of the iris shutter 212, and the downstream tube 213 is disposed at a predetermined gap from the bottom side of the iris shutter 212. The iris shutter 212 is a diaphragm opening/closing mechanism capable of opening and closing in a short time, and has a structure whereby opening and closing in a plane occur radially rather than linearly. An aggregate of articles can thereby be dropped at once from the iris shutter 212 in a short time.

The former 222 is furthermore provided below the downstream tube 213, and the former 222 is formed so as to surround the vicinity of the lower end part of the downstream tube 213. The pull-down belt 223 is provided so as to hold the downstream tube 213 from both sides thereof. The pull-down belt 223 is composed of rollers 223*a*, 223*b* and a belt having an air suction function using a vacuum pump. The vertical sealing device 224 is positioned so as to be able to seal the vertical overlapping portion of the elongated film F from which a bag is made, while heating and pressing the overlapping portion through the use of a built-in heater.

The lateral sealing device 225 is provided below the vertical sealing device 224. The lateral sealing device 225 is composed of a pair of sealing jaws 225*a*, 225*b* having built-in heaters, and is capable of sealing the horizontal direction of the elongated film F from which a bag is made. The bag compactor 500 is provided below the lateral sealing device 225. The structure and operation of the bag compactor 500 will be described in detail hereinafter.

The operation of the vertical bag-manufacturing and packaging machine 100 will next be described using FIG. 2. As shown in FIG. 2, a rolled packaging member is disposed in the vertical bag-manufacturing and packaging machine 100 so as to be able to be replaced, and the packaging member is fed as a film F by the film feeding unit 107 (see FIG. 1) in which the packaging member is housed.

The film F is then conveyed by a conveyance device and formed into a tubular film F by the former 222. The overlapping edges of the tubular film F are then heat welded and vertically sealed by the vertical sealing device 224 while the tubular film F, hanging down around the downstream tube 213, is conveyed further downward by the pull-down belt 223. The tubular film F is then heat welded by the lateral sealing device 225 composed of the pair of sealing jaws 225*a*, 225*b* and laterally sealed, and a bag B is thereby manufactured. Articles weighed by the combination weighing device 120 are retained by the upstream tube 211 and the iris shutter 212, and after the lower end part of the bag B is laterally sealed, the iris shutter 212 is released, and the articles C that pass through the downstream tube 213 are introduced and filled into the bag B.

Figure 3:
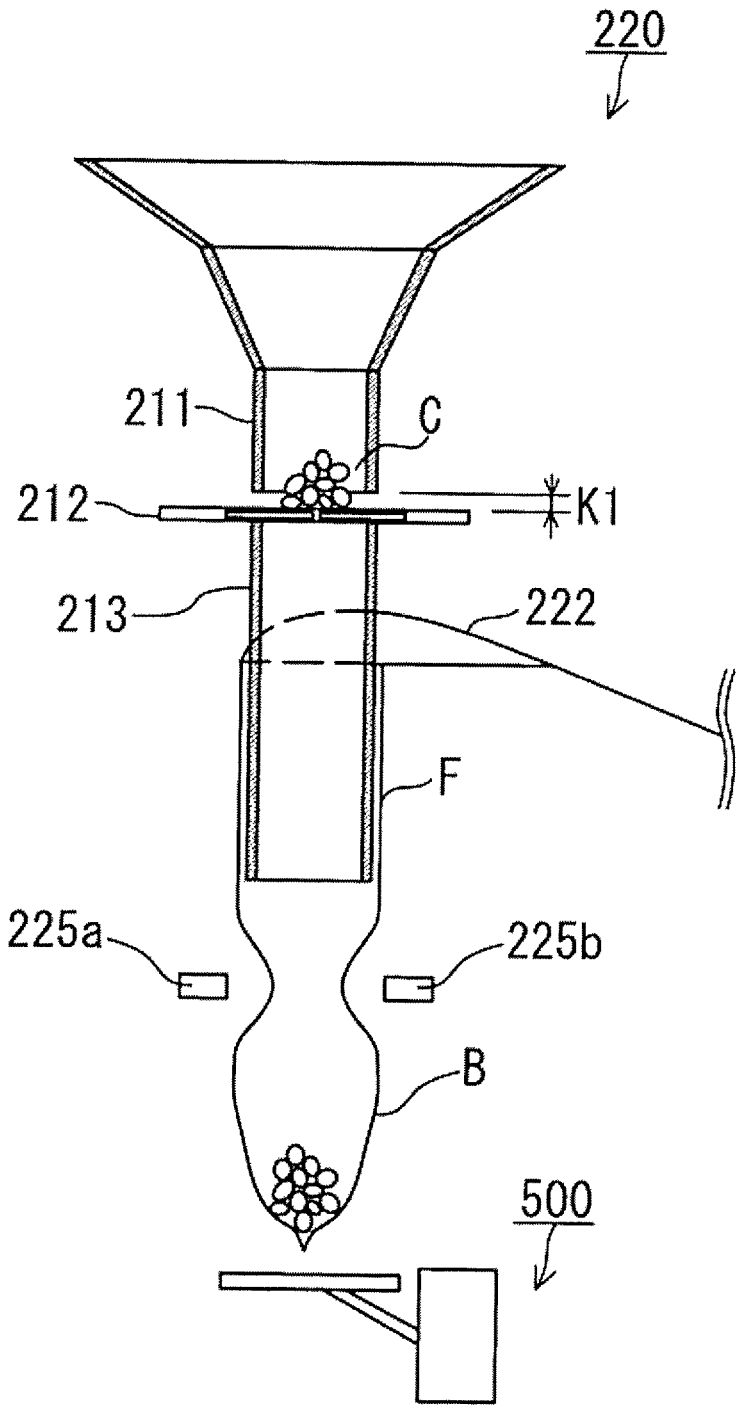
FIG. 3 is a schematic cross sectional view showing an example of the structure of the upstream tube, the iris shutter, and the downstream tube.
Figure 4:
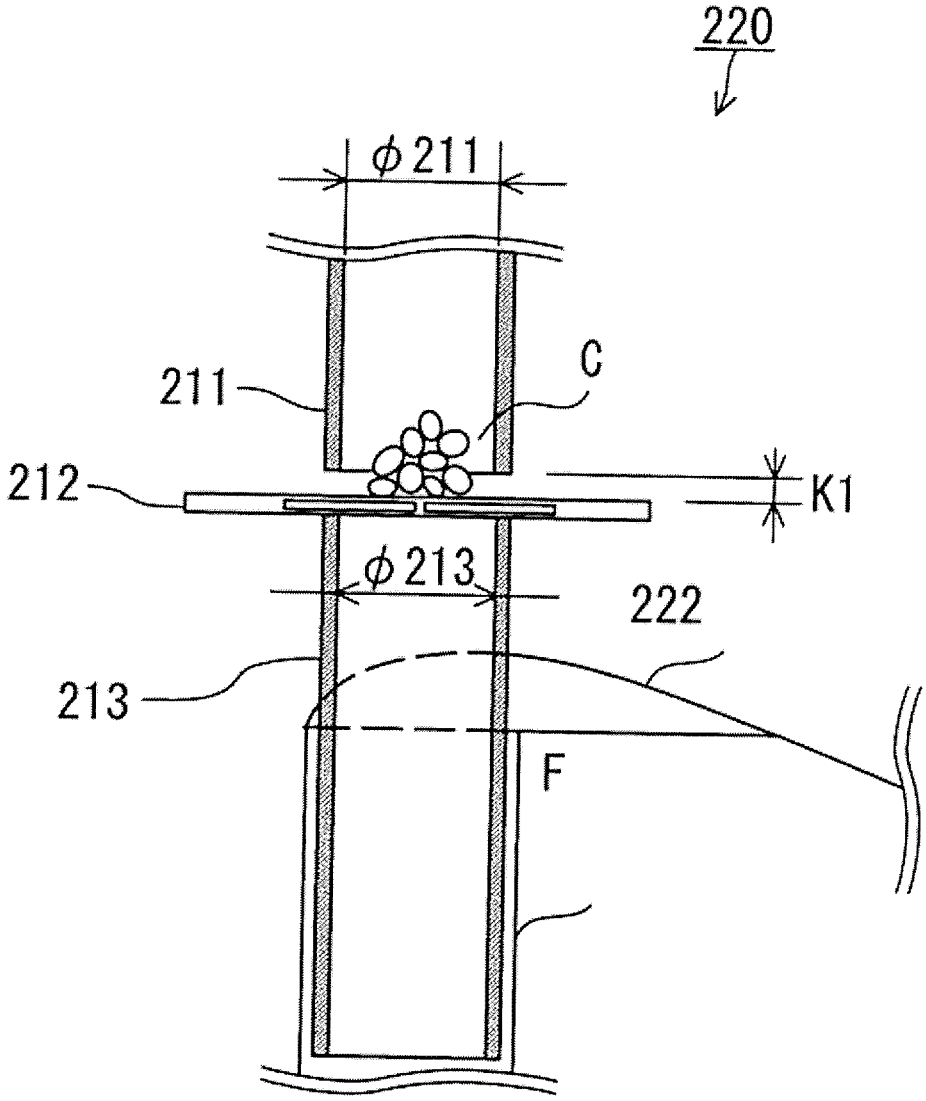
FIG. 4 is an enlarged schematic cross-sectional view showing a part of FIG. 3.

FIG. 3 is a schematic view showing an example of the feeding unit 220 of the upstream tube 211, the iris shutter 212, and the downstream tube 213, and FIG. 4 is an enlarged schematic view showing the relationships in FIG. 3.

As shown in FIG. 3, the upstream tube 211 and the downstream tube 213 are composed of cylinders having a constant cross section in the vertical direction. The iris shutter 212 is provided between the upstream tube 211 and the downstream tube 213.

As shown in FIG. 4, the diameter of the upstream tube 211 is $\phi$211, and the diameter of the downstream tube 213 is $\phi$213. The diameter $\phi$211 is preferably about 0.5 mm to 5 mm smaller than the diameter $\phi$213. The diameter $\phi$211 is more preferably about 1 mm to 2 mm smaller than the diameter $\phi$213.

As a result, the articles C are less prone to touch the internal peripheral surface of the downstream tube 213.

A gap K1 is provided between the upstream tube 211 and the iris shutter 212. The gap K1 is about 1 mm to 2 mm, for example, so that the articles C do not spill out. The size of the gap K1 is preferably 2 mm or greater and 100 mm or less. The gap K1 is formed along the entire periphery of the upstream tube 211 in the illustrated embodiment, but may also be provided along only a portion of the periphery of the upstream tube 211.

The movement of the articles C shown in FIG. 3 will next be described. Articles C having a predetermined weight are dropped into the upstream tube 211 by the combination weighing device 120. In this case, since the iris shutter 212 is closed, the flow of air created by the falling of the articles C is discharged to the outside from the gap K1, and the falling of the articles C can be hastened.

Meanwhile, in a case in which the lower end part of the bag B formed by the film F is sealed by the pair of the sealing jaws 225*a*, 225*b*, and the upper end part is open, the iris shutter 212 is opened, and the articles C are dropped as an aggregated article group. In this case, since the cylinder diameter of the downstream tube is larger than the diameter of the upstream tube 211, the falling articles C do not touch the internal peripheral surface of the downstream tube 213. The bag compactor 500 operates so as to raise the bottom surface of the bag B.

Lastly, the lower end part of the bag B is sealed by the pair of sealing jaws 225*a*, 225*b*, and the upper end part of the bag B is sealed.

FIGS. 5 through 8 are schematic views showing the details and operation of the bag compactor 500.

Figure 5:
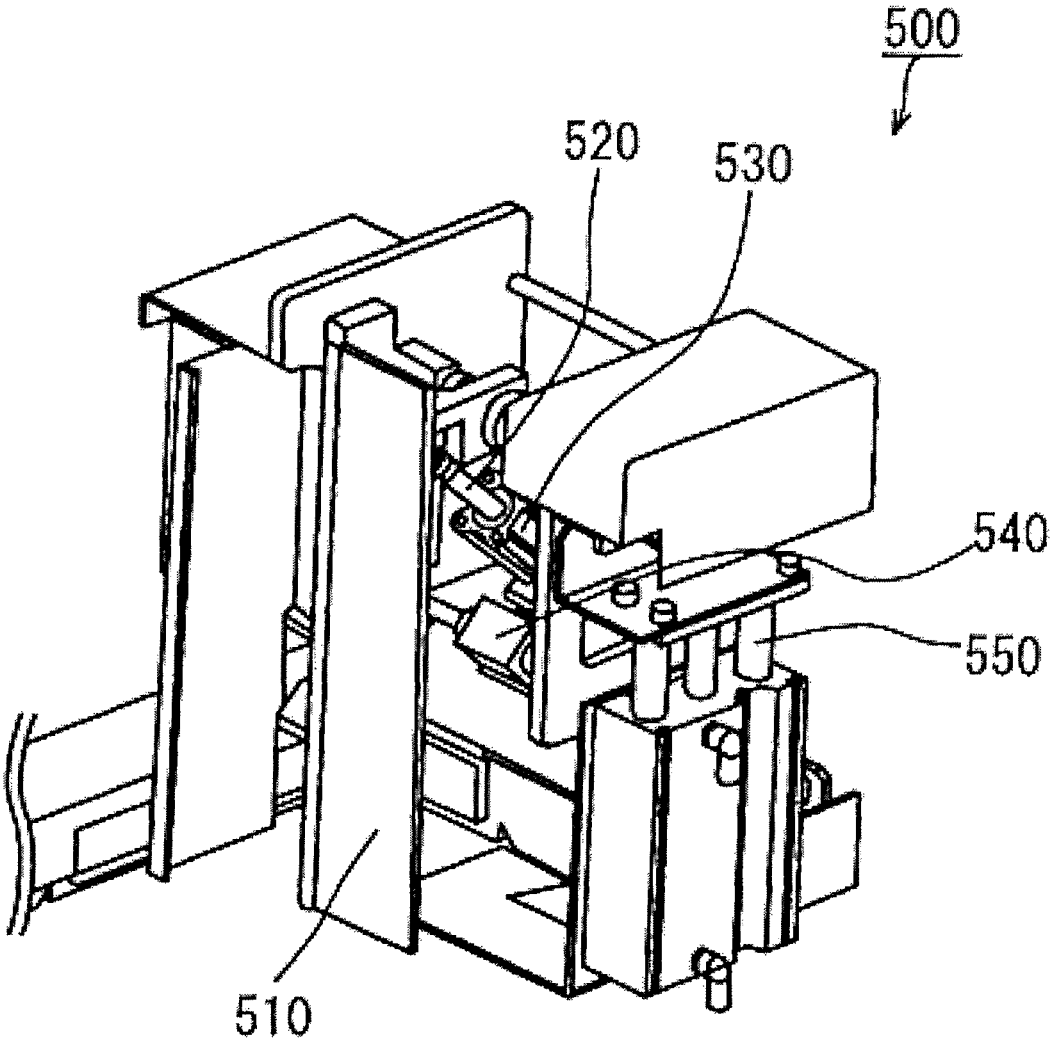
FIG. 5 is a schematic perspective view showing the details and operation of the bag compactor.

As shown in FIG. 5, the bag compactor 500 is provided with a compacting plate 510, a cylinder rod 520, a cylinder 530, a rotary device 540, and a compaction driver 550.

As shown in FIG. 5, before the bag B is formed, the compacting plate 510 is positioned in the vertical direction.

Figure 6:
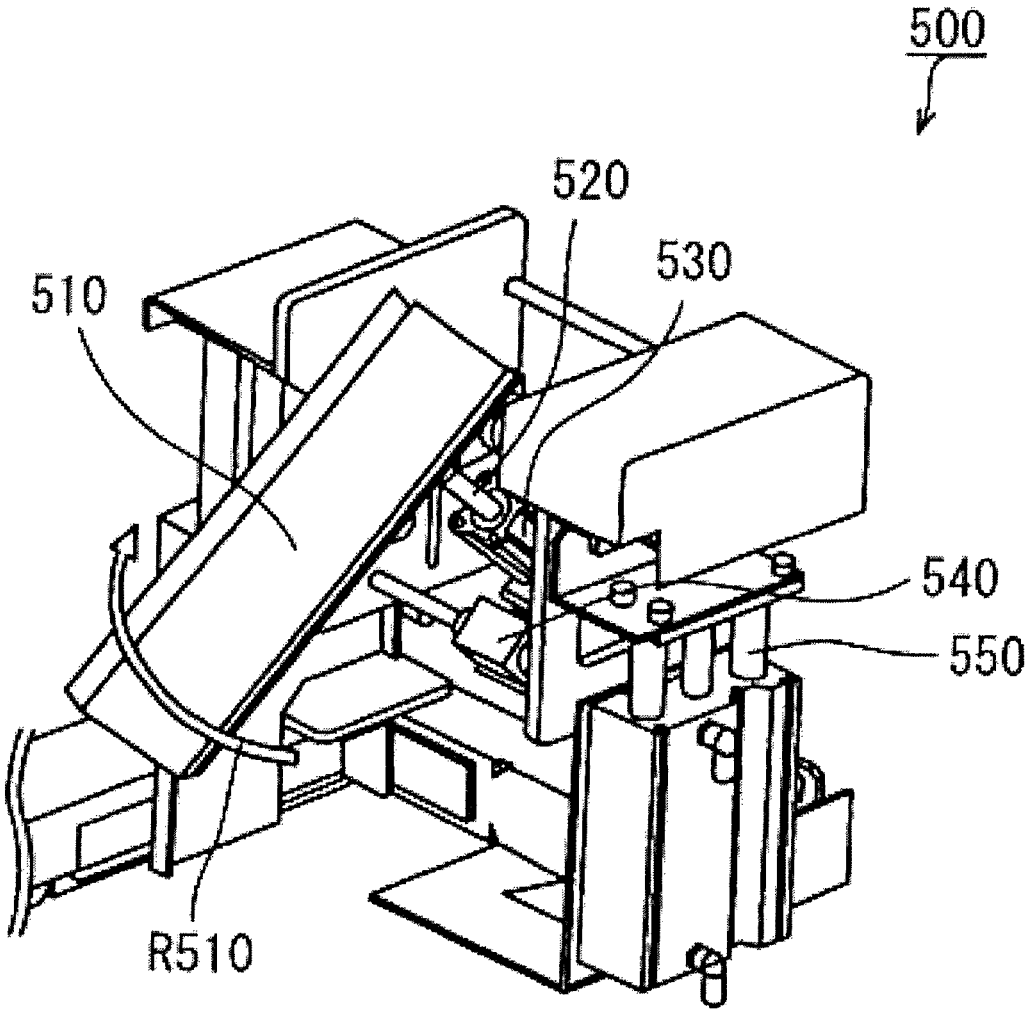
FIG. 6 is a schematic perspective view showing the details and operation of the bag compactor.

When the bag B is formed, the cylinder 530 is moved by the rotary device 540 while the cylinder rod 520 is extended at the same time, and the compacting plate 510 is rotated in the direction of the arrow R510, as shown in FIG. 6.

Figure 7:
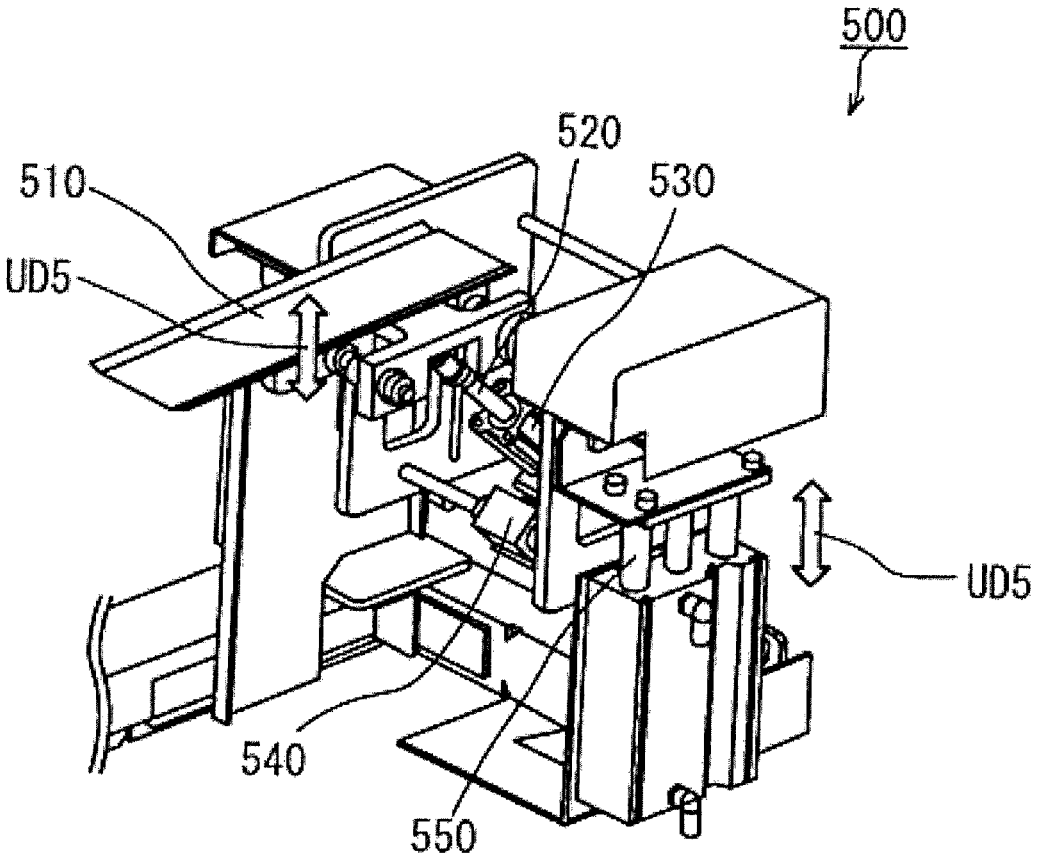
FIG. 7 is a schematic perspective view showing the details and operation of the bag compactor.

The compacting plate 510 then moves to the bottom of the formed bag B, and after the articles C are introduced into the bag B, the compaction driver 550 moves in the direction of the arrow UD5, as shown in FIG. 7. As a result, the compacting plate 510 oscillates in the direction of the arrow UD5 and imparts vibration to the articles C in the bag B. In other words, the bulkiness of the articles C in the bag B can be reduced by compaction.

Figure 8:
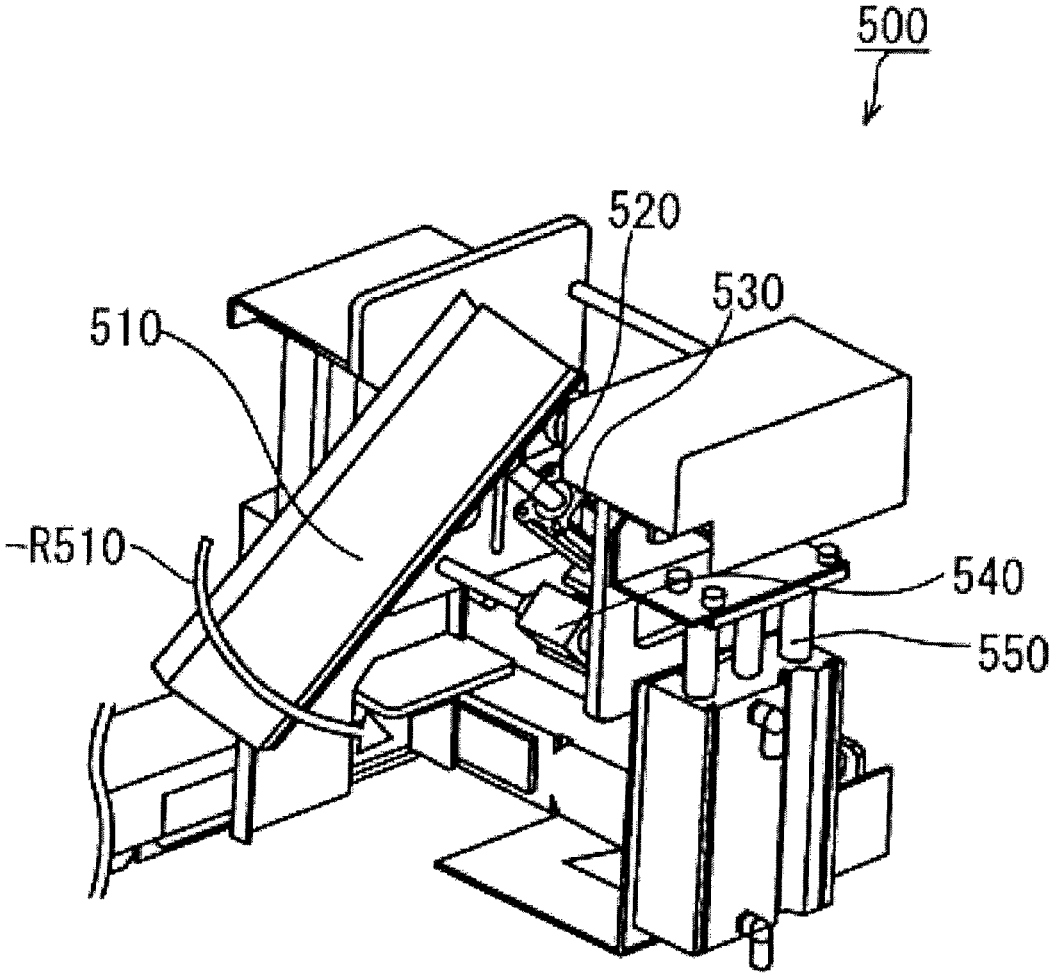
FIG. 8 is a schematic perspective view showing the details and operation of the bag compactor.

In the bag compactor 500 having finished the compaction operation, the cylinder 530 is moved by the rotary device 540 while the cylinder rod 520 is extended at the same time, and the compacting plate 510 is rotated in the direction of the arrow—R510 in FIG. 8 to return to the state shown in FIG. 5, so as not to obstruct the downward falling of the bag B in which the articles C are accommodated.

In the vertical bag-manufacturing and packaging machine according to the illustrated embodiment, the upstream and downstream of the opening/closing mechanism for feeding an article are formed so as to have a straight tubular shape. The internal diameter of the upstream tube portion is smaller than the internal diameter of the downstream tube portion, and a gap is provided between the opening/closing mechanism and a downstream end of the upstream tube portion.

Therefore, since the internal diameter of the upstream tube portion is smaller than the internal diameter of the downstream tube portion, the article is transferred without coming in contact with the internal peripheral surface of the downstream tube portion when the article passes through the opening/closing mechanism. The internal diameter of the upstream tube portion is preferably about 0.5 mm to 5 mm smaller, more preferably about 1 mm to 2 mm smaller than the internal diameter of the downstream tube portion.

Since a gap is provided between the opening/closing mechanism and the lower end part of the upstream tube portion, air can escape from the gap even when an article is transferred in a state in which the opening/closing mechanism is blocked. Air resistance against the article can therefore be minimized.

In the illustrated embodiment, the opening/closing mechanism includes an iris diaphragm structure. Therefore, a plurality of articles can be transferred as an article group in which the articles are collected into an aggregated group. As a result, articles can be rapidly transferred downward in the downstream tube with minimal air resistance, and the potential for mixing with other article groups can be reduced.

Other Embodiments

Figure 9:
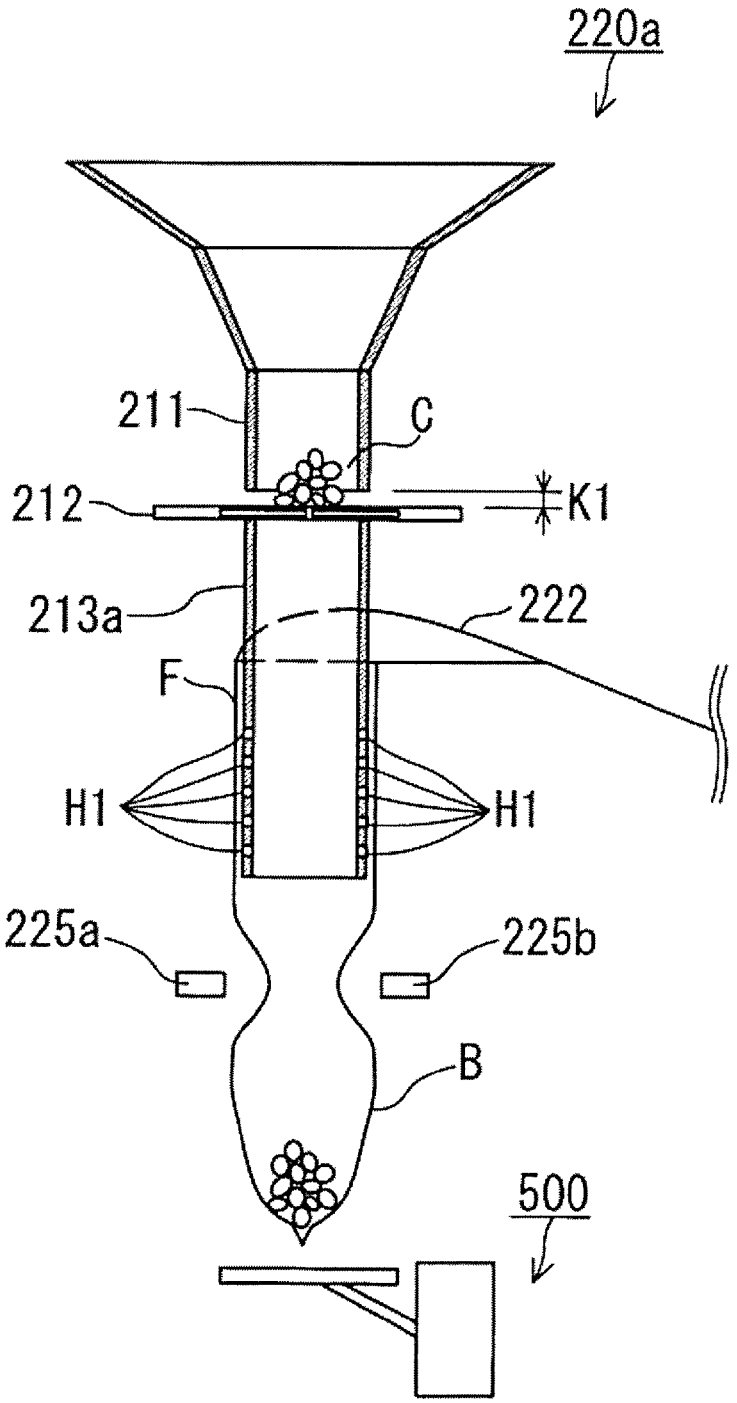
FIG. 9 is a schematic cross-sectional view showing structures of the upstream tube, the iris shutter, and the downstream tube according to another embodiment.

FIG. 9 is a schematic view showing another example of the feeding unit 220 of the upstream tube 211, the iris shutter 212, and the downstream tube 213 shown in FIG. 3. In the feeding unit 220*a* shown in FIG. 9, a downstream tube 213*a* is provided instead of the downstream tube 213 of the feeding unit 220 shown in FIG. 3. The main differences between the feeding unit 220*a* and the feeding unit 220 are described below.

As shown in FIG. 9, the downstream tube 213*a* is obtained by forming a plurality of holes H1 in the downstream tube 213. Using the downstream tube 213*a* provided with the plurality of holes H1 makes it possible to reduce air resistance on the articles C by discharging air from the plurality of holes H1 as the falling articles C move within the downstream tube 213*a*.

In this embodiment, the downstream tube portion has a plurality of holes. Therefore, when an article is transferred in the downstream tube portion, air resistance that occurs during free fall of the article can be naturally reduced.

Figure 10:
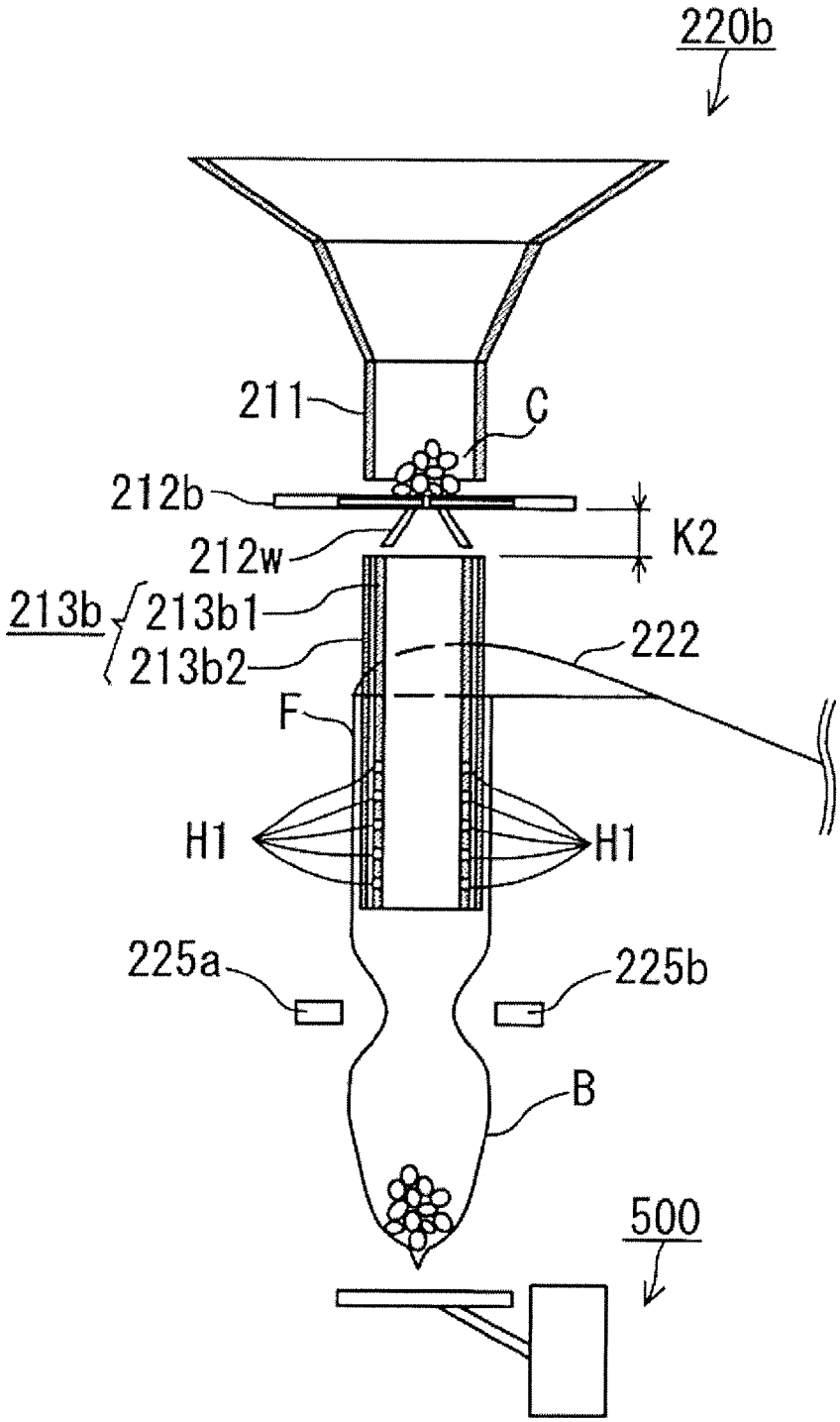
FIG. 10 is a schematic cross-sectional view showing structures of the upstream tube, the iris shutter, and the downstream tube according to another embodiment.

FIG. 10 is a schematic view showing another example of the feeding unit 220 of the upstream tube 211, the iris shutter 212, and the downstream tube 213 shown in FIGS. 3 and 9, and FIGS. 11 and 12 are schematic enlarged views showing the effect of the feeding unit 220.

In the feeding unit 220*b* shown in FIG. 10, a downstream tube 213*b* composed of a double tube is provided instead of the downstream tube 213 of the feeding unit 220 shown in FIG. 3, and an iris shutter 212*b* is provided instead of the iris shutter 212. The main differences between the feeding unit 220*b* and the structures 220, 220*a* are described below.

As shown in FIG. 10, the downstream tube 213*b* composed of a double tube is provided with an inner tube 213*b*1 and an outer tube 213*b*2. The inner tube 213*b*1 is provided with a plurality of holes H1.

As shown in FIG. 10, the iris shutter 212*b* has a plurality of blades 212*w* provided at a downward angle. The blades 212*w* are fixed to a shutter of the iris shutter 212*b*, and move in the horizontal direction with the opening and closing of the shutter. Consequently, there is no need for a drive source for the blades 212*w*, and an increase of costs can be avoided.

The feeding unit 220*b* differs from the structures 220, 220*a* in that a gap K2 larger than the size of the blades 212*w* is provided between the iris shutter 212*b* and the downstream tube 213*b* composed of a double tube.

Figure 11:
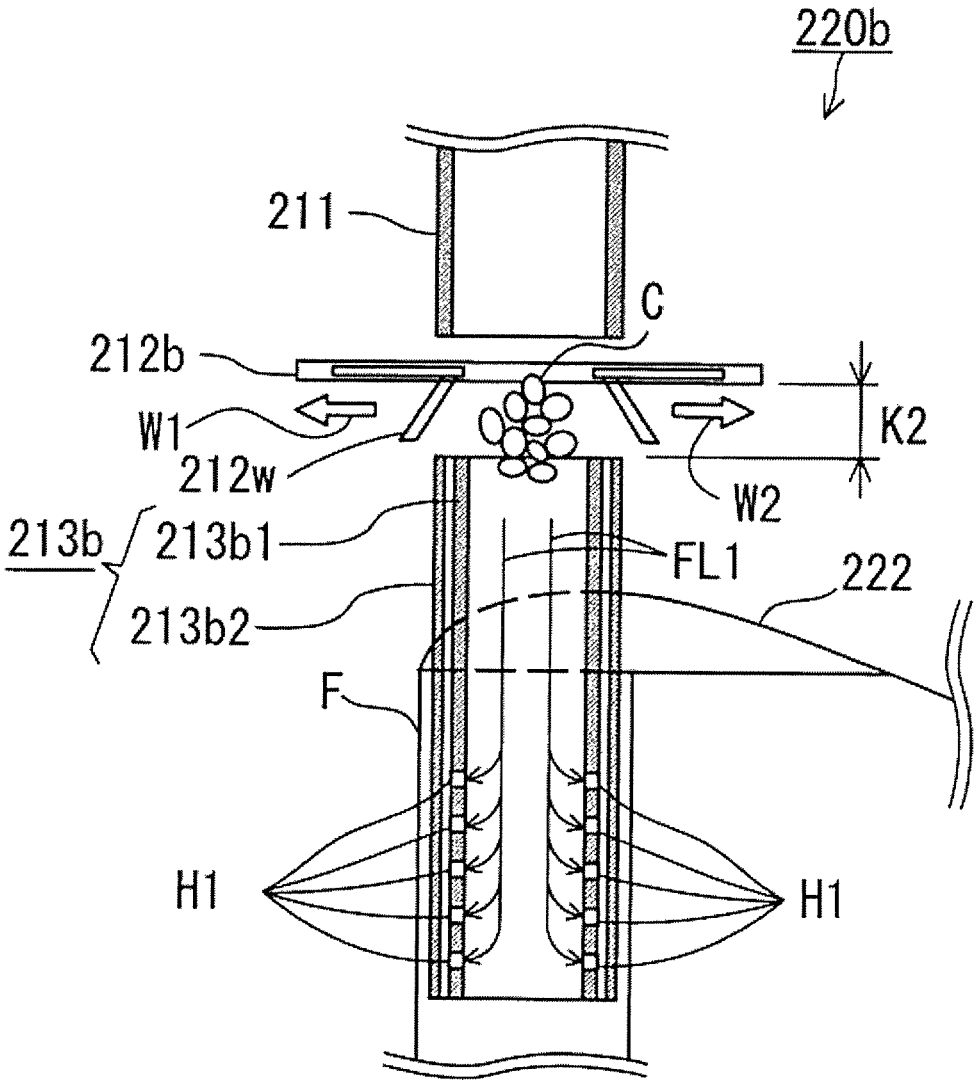
FIG. 11 is an enlarged schematic cross-sectional view showing an effect of the structure shown in FIG. 10.

As shown in FIG. 11, when the iris shutter 212*b* opens, the blades 212*w* move in the respective directions indicated by the arrow W1 and the arrow W2. In the illustrated embodiment, since the iris shutter is composed of three plates as shown in FIG. 2, the arrow W1 and the arrow W2 indicate directions that are 120 degrees apart in the horizontal plane.

In this case, a flow of air indicated by the arrows FL1 is generated by the blades 212*w*. As a result, the flow of air indicated by the arrows FL1 is discharged from the plurality of holes H1, and is discharged from the gap between the inner tube 213*b*1 and the outer tube 213*b*2 of the downstream tube 213*b* composed of a double tube. Consequently, air resistance can be reduced when the articles C fall.

Figure 12:
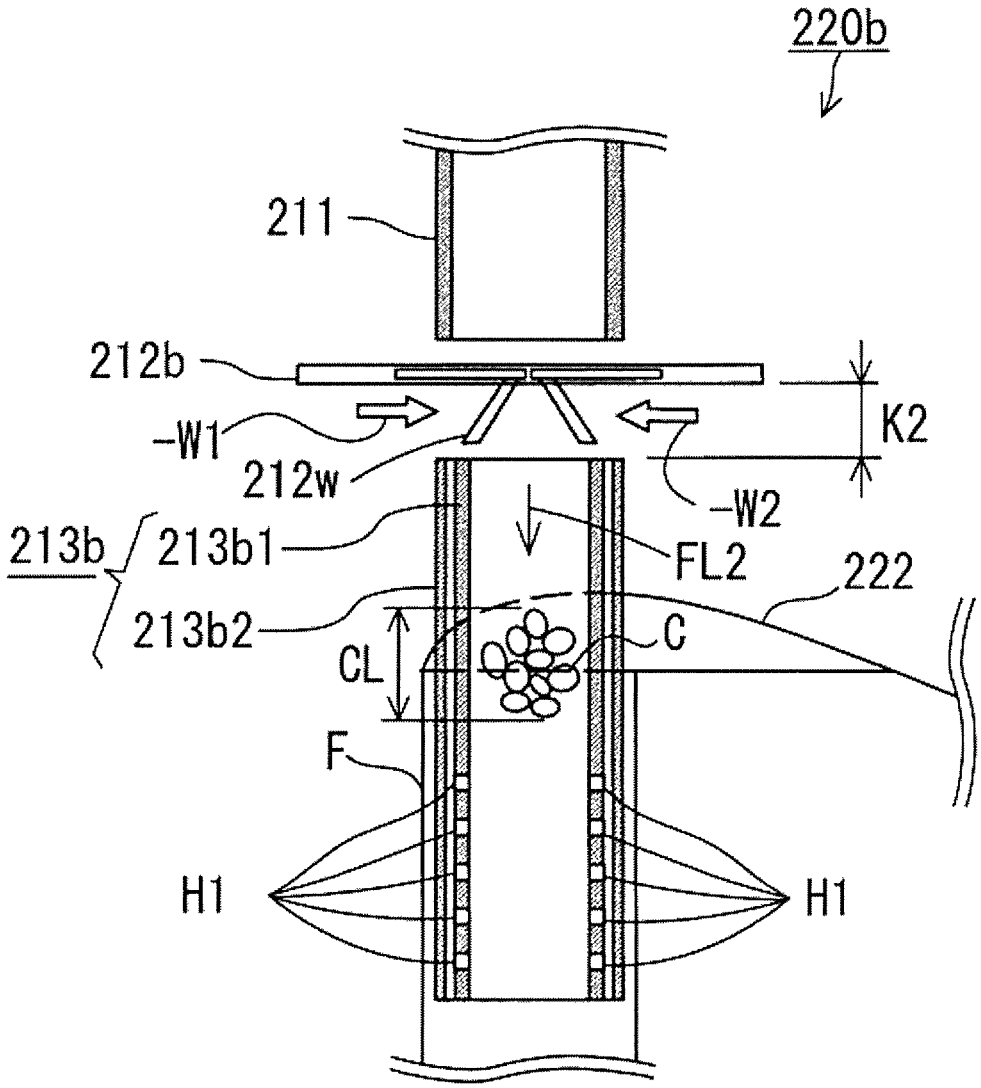
FIG. 12 is an enlarged schematic cross-sectional view showing an effect of the structure shown in FIG. 10.

As shown in FIG. 12, when the iris shutter 212*b* closes, the blades 212*w* move in the respective directions indicated by the arrow—W1 and the arrow—W2.

In this case, a flow of air indicated by the arrow FL2 is generated by the blades 212*w*. As a result, the flow of air indicated by the arrow FL2 exerts a vertical downward pressing force on the falling articles C, and the fall distance CL when the articles C fall can be reduced.

In this embodiment, the opening/closing mechanism has a plurality of flow-straightening blades disposed towards the downstream side. The flow-straightening blades are configured to move in a radial direction from a center toward an outside with respect to the downstream tube portion during an opening operation from a closed state of the opening/closing mechanism, and to move in a radial direction from the outside toward the center with respect to the downstream tube portion during a closing operation from an open state of said opening/closing mechanism.

In this case, the flow-straightening blades are provided between the opening/closing mechanism and the downstream tube portion. As a result, the air inside the downstream tube portion can be discharged to the outside from the plurality of holes by the operation of the flow-straightening blades that accompanies the opening operation of the opening/closing mechanism, and air resistance in the downstream tube portion can thereby be reduced. Articles transferred in the downstream tube portion can also be pushed downward by the operation of the flow-straightening blades that accompanies the closing operation of the opening/closing mechanism.

Consequently, an article group in which articles are collected into an aggregated group can be rapidly transferred downward in the downstream tube portion. Since the flow-straightening blades are operated by the same drive source as the opening/closing mechanism, cost can be prevented from increasing.

Figure 13:
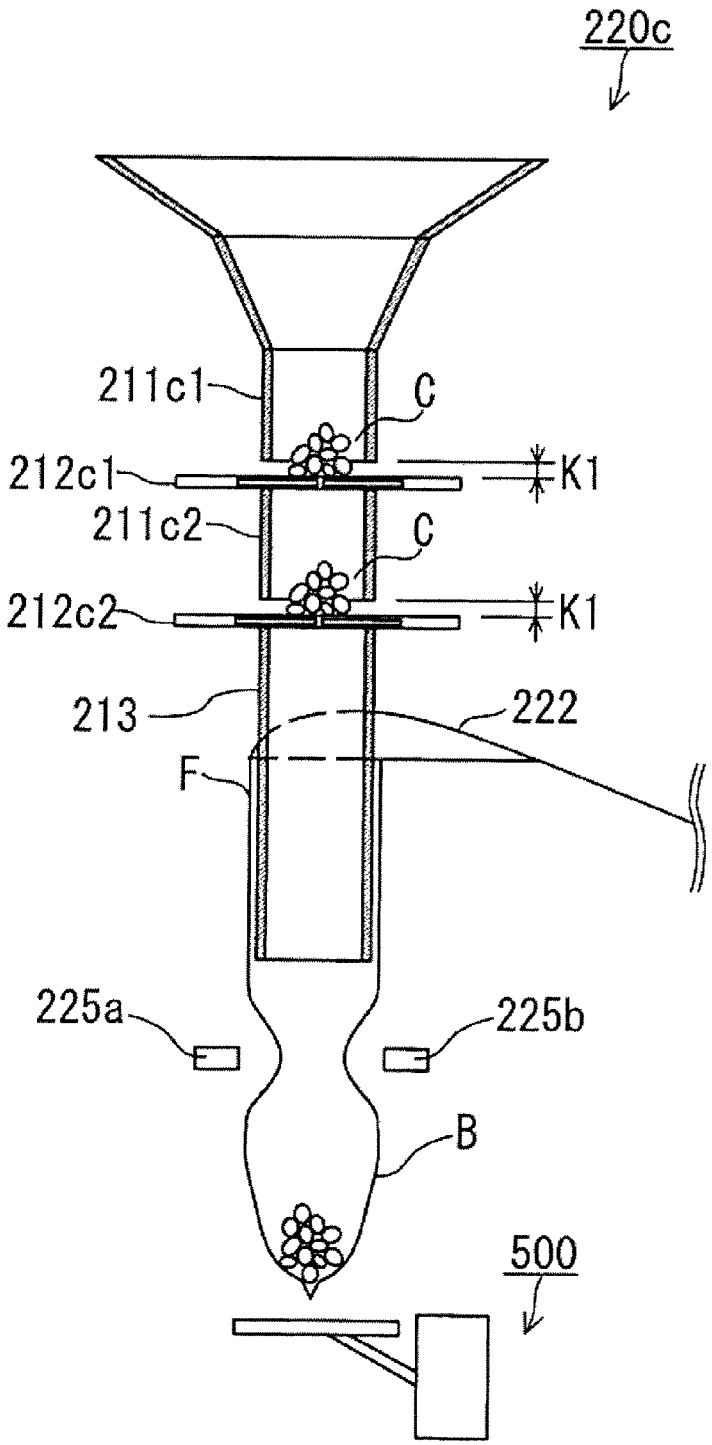
FIG. 13 is a schematic cross-sectional view showing structures of the upstream tube, the iris shutter, and the downstream tube according to another embodiment.
Figure 14:
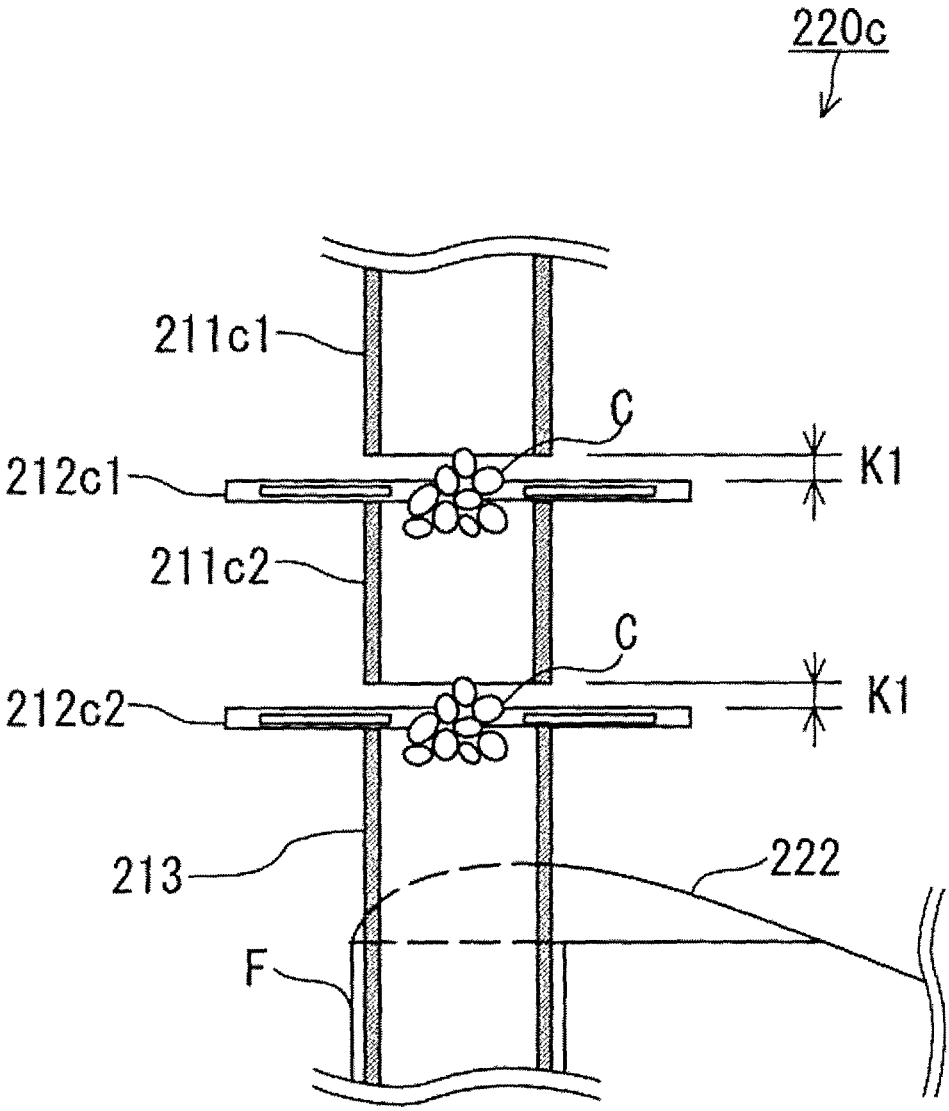
FIG. 14 is an enlarged schematic cross-sectional view showing an operation of the structure shown in FIG. 13.

FIG. 13 is a schematic view showing another example of the feeding unit 220 of another upstream tube 211, the iris shutter 212, and the downstream tube 213. FIG. 14 is a view showing the operation shown in FIG. 13. The main differences between the feeding unit 220*c* and the feeding unit 220 are described below.

In the feeding unit 220*c* shown in FIG. 13, iris shutters 212*c*1, 212*c*2 are provided instead of the iris shutter 212, and an upstream tube 211*c*1 and an upstream tube 211*c*2, which is between the iris shutters 212*c*1 and 212*c*2, are provided instead of the upstream tube 211.

As shown in FIG. 13, a gap K1 is provided between the upstream tube 211*c*1 and the iris shutter 212*c*1, and a gap K1 is provided between the upstream tube 211*c*2 and the iris shutter 212*c*2.

As shown in FIG. 14, the opening operation of the iris shutter 212*c*1 and the opening operation of the iris shutter 212*c*2 in the feeding unit 220*c* may be performed simultaneously, and the closing operation of the iris shutter 212*c*1 and the closing operation of the iris shutter 212*c*2 may be performed simultaneously. Air resistance can thereby be reduced when the articles C are dropped.

In this embodiment, an additional opening/closing mechanism is disposed on an upstream side of the upstream tube portion, and the opening/closing mechanism and the additional opening/closing mechanism are configured and arranged to perform an opening/closing operation simultaneously.

In this case, since there are a plurality of opening/closing mechanisms provided at a predetermined vertical interval, and the opening operation and the closing operation of the opening/closing mechanism on the upstream side and the opening/closing mechanism on the downstream side are performed simultaneously, article groups in which articles are collected into an aggregated group can be transferred with reduced air resistance. In other words, when one opening/closing mechanism closes while the other opening/closing mechanism is open, air accumulates in the space, and air resistance occurs. Consequently, the air resistance can be reduced by adopting a configuration in which the opening operation and the closing operation of the opening/closing mechanism on the upstream side and the opening/closing mechanism on the downstream side are performed simultaneously.

Figure 15:
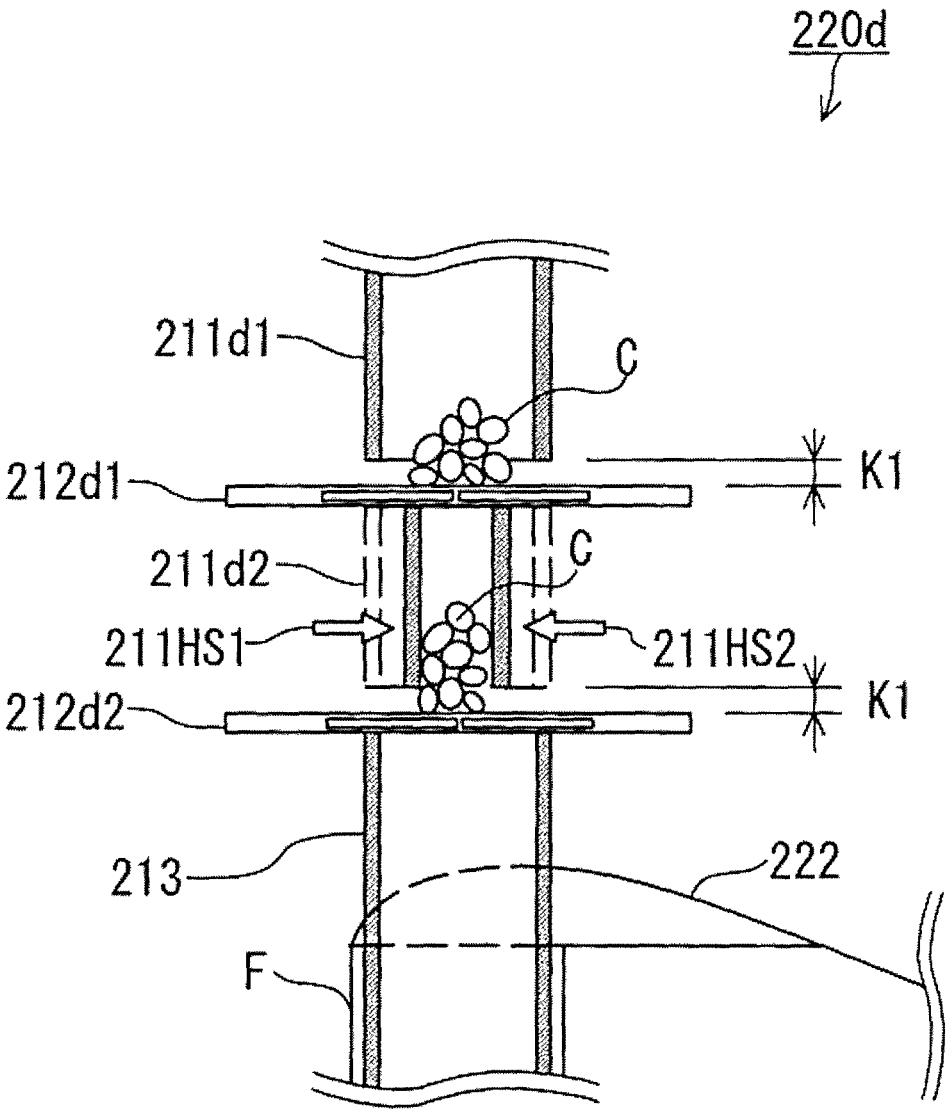
FIG. 15 is a schematic cross sectional view showing a modified structure of the structure shown in FIG. 13.
Figure 16:
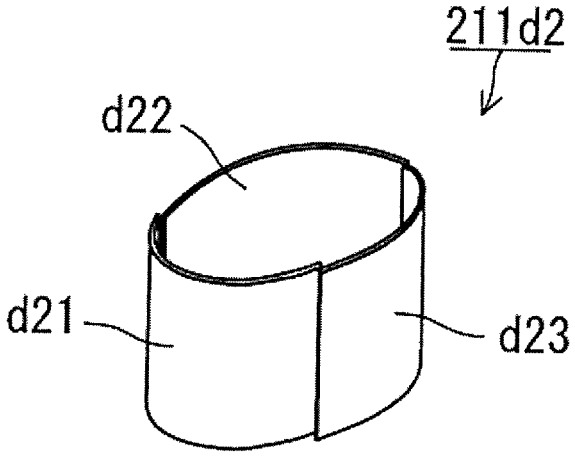
FIG. 16 is a schematic view showing the operation of the diaphragm tube shown in FIG. 15.
Figure 17:
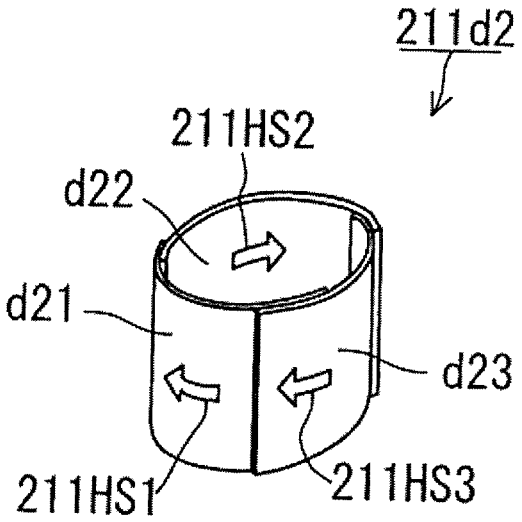
FIG. 17 is a schematic view showing the operation of the diaphragm tube shown in FIG. 15.

FIG. 15 is a schematic view showing another example of the feeding unit 220*c* shown in FIG. 13, and FIGS. 16 and 17 are views showing the operation of a diaphragm tube 211*d*2 shown in FIG. 15. The main differences between the feeding unit 220*d* and the feeding unit 220*c* are described below.

As shown in FIG. 15, iris shutters 212*d*1, 212*d*2 are provided instead of the iris shutters 212*c*1, 212*c*2 in the feeding unit 220*d*, and an upstream tube 211*d*1 and a diaphragm tube 211*d*2, which is between the iris shutters 212*c*1 and 212*c*2, are provided instead of the upstream tube 211.

As shown in FIG. 16, the diaphragm tube 211*d*2 in the illustrated embodiment is composed of a plurality of plates, i.e., three curved plates d21, d22, d23. As shown in FIGS. 15 and 17, the curved plate d21 moves in the direction of the arrow 211HS1, the curved plate d22 moves in the direction of the arrow 211HS2, and the curved plate d23 moves in the direction of the arrow 211HS3.

As a result, the bulkiness of the articles C can be adjusted, as shown in FIG. 15. The articles C can therefore be dropped as reliably aggregated article groups when the articles C are dropped from the iris shutter 212*d*2, and the fall distance can also be reduced.

In this embodiment, the upstream tube portion includes a diameter variable structure configured and arranged to vary the internal diameter of the upstream tube portion. Therefore, the internal diameter of the variable tube can be reduced in order to collect a plurality of articles into an aggregated group. As a result, articles can be transferred to the downstream side as aggregated groups of articles.

Through the vertical bag-manufacturing and packaging machine according to the illustrated embodiments, articles can be transferred without coming in contact with the internal peripheral surface of the straight tube.

In the vertical bag-manufacturing and packaging machine 100 according to the embodiments described above, since the diameter ϕ211 of the upstream tube 211 of the iris shutter 212 is smaller than the diameter ϕ213 of the downstream tube 213, the articles C that pass through the iris shutter 212 are transferred without coming in contact with the internal peripheral surface of the downstream tube 213.

Since the gap K1 is provided between the iris shutter 212 and the upstream tube 211, air can escape from the gap K1 even when the articles C are transferred in a state in which the iris shutter 212 is blocked. Air resistance against the articles C can therefore be minimized. As a result, articles can be rapidly transferred downward in the downstream tube 213 with minimal air resistance, and the potential for mixing with other article groups can be reduced.

Furthermore, since the iris shutter 212 is composed of an iris diaphragm mechanism, a plurality of articles C can be transferred as an article group in which the articles are collected into an aggregated group.

Since a plurality of holes H1 are provided, when the articles C are transferred in the downstream tube 213, air resistance that occurs during free fall of the articles C can be naturally reduced.

In the vertical bag-manufacturing and packaging machine 100 according to the illustrated embodiment, the iris shutters 212, 212*b*, 212*c*2, 212*d*2 correspond to the opening/closing mechanism and the iris diaphragm structure, the upstream tubes 211, 211*c*2, 211*d*2 correspond to the upstream tube portion, the downstream tubes 213, 213*a*, 213*b* correspond to the downstream tube portion, the diameter ϕ211 corresponds to the internal diameter of the upstream tube portion, the diameter ϕ213 corresponds to the internal diameter of the downstream tube portion, the blades 212*w* correspond to the flow-straightening blades, the iris shutters 212*c*1, 212*d*1 correspond to the additional opening/closing mechanism, and the diaphragm tube 211*d*2 corresponds to the diameter variable structure.

In the illustrated embodiment, the blades 212*w* are provided at an angle, but they are not limited to this configuration, and the blades 212*w* may also be configured so as to extend vertically downward.

The bag compactor 500 having a compacting plate 510 is also provided, but it is not limited to this configuration, and a compacting rod or the like may also be used.

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A vertical bag-manufacturing and packaging machine comprising:

a feeding unit configured and arranged to convey articles supplied from an upstream portion downwardly to a downstream portion, the feeding unit including an upstream tube portion configured and arranged to downwardly convey the articles, an opening/closing mechanism disposed on a downstream side of the upstream tube portion having a movable surface, with a gap being open to an exterior of the upstream tube portion from a downstream end of the upstream tube portion to the movable surface of the opening/closing mechanism, the movable surface being configured and arranged to selectively move between an open position allowing the articles to discharge downward through the opening/closing mechanism and a closed position holding the articles discharged by the upstream tube portion, the gap being open to the exterior of the upstream tube portion with the movable surface being in the closed position, the gap being provided to allow air flow out of the gap, the air flow through the gap being created by the falling articles such that air resistance against the articles is low as the articles move downward through the upstream tube portion with the movable surface being in the closed position, and a downstream tube portion disposed on a downstream side of the opening/closing mechanism, and configured and arranged to downwardly convey the articles discharged by the opening/closing mechanism with the movable surface in the open position, the downstream tube portion having an internal diameter that is larger than an internal diameter of the upstream tube portion, the downstream tube portion being directly below the upstream tube portion.

2. The vertical bag-manufacturing and packaging machine according to claim 1, wherein the opening/closing mechanism includes an iris diaphragm structure, the movable surface being defined on a portion of the iris diaphragm structure.

3. The vertical bag-manufacturing and packaging machine according to claim 1, wherein the downstream tube portion has a plurality of holes.

4. The vertical bag-manufacturing and packaging machine according to claim 3, wherein the opening/closing mechanism has a plurality of flow-straightening blades disposed towards the downstream side, the movable surface being defined on a at least one of the plurality of flow-straightening blades, the flow-straightening blades being configured to move in a radial direction from a center toward an outside with respect to the downstream tube portion during an opening operation from a closed state of the opening/closing mechanism, and to move in a radial direction from the outside toward the center with respect to the downstream tube portion during a closing operation from an open state of said opening/closing mechanism.

5. The vertical bag-manufacturing and packaging machine according to claim 1, further comprising an additional opening/closing mechanism disposed on an upstream side of the upstream tube portion, the opening/closing mechanism and the additional opening/closing mechanism being configured and arranged to perform an opening/closing operation simultaneously.

6. The vertical bag-manufacturing and packaging machine according to claim 1, wherein the upstream tube portion includes a diameter variable structure configured and arranged to vary the internal diameter of the upstream tube portion.

7. The vertical bag-manufacturing and packaging machine according to claim 4, wherein the downstream tube portion having a double tube structure with an outer tube and an inner tube, the holes being provided only in the inner tube.

8. The vertical bag-manufacturing and packaging machine according to claim 1, wherein the gap is dimensioned such that with the movable surface in the closed position a flow of air created by the falling of the articles is discharged through the gap to the exterior of the upstream tube portion.

9. The vertical bag-manufacturing and packaging machine according to claim 1, further comprising a bag former at least partially surrounding a lower end of the downstream tube portion.

10. The vertical bag-manufacturing and packaging machine according to claim 1, wherein the opening/closing mechanism includes an iris shutter that moves radially opening and closing in a short time, such that in the open position the articles discharge at once.

11. The vertical bag-manufacturing and packaging machine according to claim 1, wherein the gap allows airflow out of the upstream tube portion with the opening/closing mechanism the closed position such that falling of the articles through the upstream tube portion is hastened.

12. The vertical bag-manufacturing and packaging machine according to claim 11, wherein the gap is sized to prevent the articles do not spill out through the gap.

13. The vertical bag-manufacturing and packaging machine according to claim 1, wherein with the movable surface in the closed position the gap is 2 mm or greater and is 100 mm or less.

14. The vertical bag-manufacturing and packaging machine according to claim 8, wherein with the movable surface in the closed position the gap is 2 mm or greater and is 100 mm or less.

* * * * *